US012535002B1

(12) United States Patent
Seutter

(10) Patent No.: US 12,535,002 B1
(45) Date of Patent: Jan. 27, 2026

(54) MECHANISM FOR GENERATING DOWNLINK CONFIRMATION SIGNAL

(71) Applicant: Halliburton Energy Services, Inc., Houston, TX (US)

(72) Inventor: Daniel Seutter, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/011,587

(22) Filed: Jan. 6, 2025

(51) Int. Cl.
*E21B 47/18* (2012.01)
*E21B 34/14* (2006.01)

(52) U.S. Cl.
CPC ..... *E21B 47/18* (2013.01); *E21B 34/14* (2013.01)

(58) Field of Classification Search
CPC ..... E21B 47/18; E21B 47/20; E21B 47/22; E21B 47/24
See application file for complete search history.

(56) References Cited

U.S. PATENT DOCUMENTS 3,466,755 A * 9/1969 Alder ..... E21B 21/08 175/45
3,468,035 A * 9/1969 Taylor, Jr. ..... E21B 47/24 33/307
3,571,936 A * 3/1971 Taylor, Jr. ..... E21B 47/02 175/45
4,825,421 A * 4/1989 Jeter ..... E21B 47/18 367/83
5,117,398 A * 5/1992 Jeter ..... E21B 47/18 367/85
8,794,354 B2 8/2014 Xu et al.
9,341,027 B2 5/2016 Radford et al.
12,060,794 B2 8/2024 Seutter
2024/0052706 A1* 2/2024 Seutter ..... E21B 10/322

OTHER PUBLICATIONS

Weatherford, Drilling Services, Riptide Drilling Reamer, Maximizing hole-enlargement-while drilling speed and reliability, 2004-2017.
SLB, Rhino multicycle hydraulic underreamer, 2024.

* cited by examiner

*Primary Examiner* — Blake Michener
(74) *Attorney, Agent, or Firm* — Michael Jenney; C. Tumey Law Group, PLLC

(57) ABSTRACT

A downhole signal generation system may include a main housing, a spring, and a valve plug configured to move along a central bore of the main housing between an open position and a closed position to selectively block fluid flow through the main housing. The downhole signal generation system may further include a ball housing insert with a ball slot and a ball release collar disposed about the ball housing insert. The downhole signal generation system may also include a latching feature configured to secure the valve plug to the ball housing insert with the ball release collar in a holding position, and to release the valve plug in response to the ball release collar moving to the release position. Moreover, the spring may be configured to drive the valve plug from the open position to the closed position in response to the latching feature releasing the valve plug.

20 Claims, 13 Drawing Sheets

MECHANISM FOR GENERATING DOWNLINK CONFIRMATION SIGNAL

BACKGROUND

Wells are commonly drilled to recover hydrocarbons such as oil and gas from subterranean formations. Various downhole tools (e.g., reamers, etc.) may be used during drilling operations. Such downhole tools may be activated in response to an activation signal output from the surface. Activation signals may include electrical signals, pressure signals, rotational signal (e.g., rotation of a drill string) communicated downhole. In response to receiving the activation signal(s) the downhole tool may be configured to activate. For example, a reamer may be configured to expand its reamer arms to engage a wellbore in response to receiving the activation signal. Unfortunately, complications downhole may prevent activation of the downhole tool after the activation signal is output from surface. Continuing drilling operations without the activation of the downhole tool (e.g., the reamer) activating may delay and/or compromise downhole drilling operations.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for outputting a predefined confirmation signal to surface and, more particularly, example embodiments may include a signal generation system configured to output predefined confirmation signal. As set forth in greater detail below, the signal generation mechanism is configured to actuate in response to instructions from electronic control board. Further, actuating the signal generation mechanism may include moving a valve plug between a closed position and an open position at predefined rates to produce the predefined confirmation signal, which may be detected at surface as confirmation of activation of a downhole tool such as a reamer or any other suitable downhole tool. Receiving the confirmation signal at surface may reduce delay and/or other issues associated with downhole drilling operations.

Figure 1:
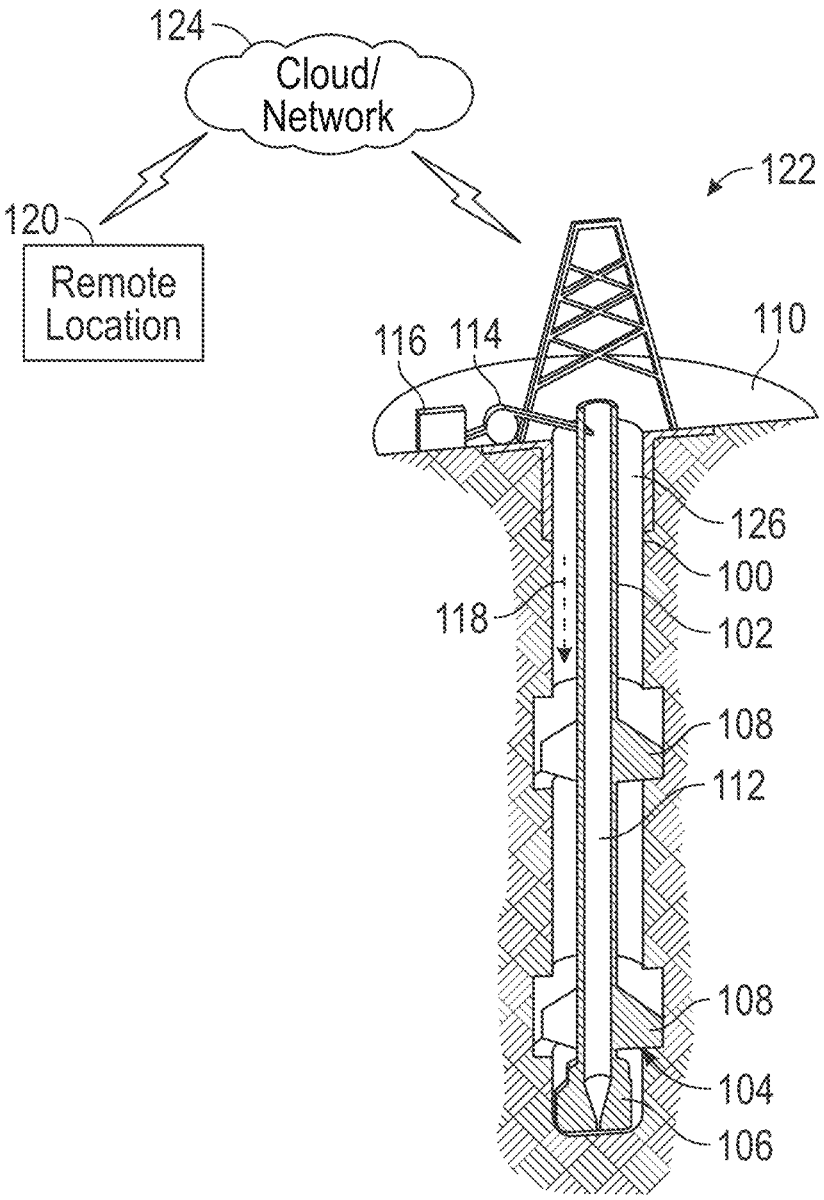
FIG. 1 illustrates an elevation view of a well system, in accordance with some embodiments of the present disclosure.

FIG. 1 illustrates an elevation view of a well system, in accordance with some embodiments of the present disclosure. A wellbore 100 may be drilled using a drill string 102 having at least one downhole tool 104. For example, as illustrated, the wellbore 100 may be drilled using a drill string 102 having a drill bit 106 at the lower end and at least one reamer 108 supported anywhere along the drill string 102 above the drill bit 106. This particular example shows two reamers 108 supported at different axial locations on the drill string 102 above the drill bit 106. The wellbore 100 may be drilled by rotating the entire drill string 102 from surface 110 and/or by rotating the drill bit 106 relative to the drill string 102, such as using a mud motor. The reamers 108 are typically deactivated during drilling and would rotate along with the drill string 102 without appreciably engaging the wellbore 100. A portion of the wellbore 100 may then be subsequently reamed by activating the reamers 108 and rotating the drill string 102 with reamer arms engaging a selected portion of the wellbore 100, as further discussed below. However, if desired, drilling and reaming could be performed simultaneously, such as by rotating the drill string with the reamers activated to extend the wellbore and simultaneously ream an existing portion of the wellbore uphole of the drill bit. A variety of drill string configurations and drill string modes of operation are known in the art including various uses of drill string rotation, mud motor rotation, and combinations thereof for achieving any of a variety of wellbore forming steps and features, any of which may incorporate aspects of this disclosure.

The drill string 102 may be progressively assembled over the course of drilling by adding any number of drill pipe segments or stands 112, the reamers 108, and other drill string components until the desired wellbore depth is reached. Because the reamers 108 in this example are included on the same drill string 102 used to drill the wellbore 100, the wellbore 100 may be drilled and reamed in a single trip. However, a reamer and method according to the disclosure may be used to ream an existing wellbore if desired.

While drilling or reaming, fluid may be circulated downhole to help lubricate the bit or reamer cutting structures and circulate the cuttings back to surface. Typically, the overall downhole fluid path would be down through the drill string 102 and up through an annulus 126 between the drill string 102 and the wellbore 100, as diagrammed. One or more surface pump 114 may be provided at the surface 110 to generate the pressurized flow. A filtration system 116 may be provided at surface to remove the bulk of cuttings and other contaminants from the fluid as it is circulated. As this fluid circulation equipment is generally available for drilling purposes, the fluid circulated downhole may be referred to herein as downhole fluid, even when not actively drilling or reaming. This pressurized downhole fluid may additionally be used as described below to activate the reamer(s) 108.

The reamers 108 are generally tripped into the wellbore 100 in a deactivated state (e.g., with reamer arms retracted) as further discussed in relation to subsequent figures. The reamers 108 may be selectively activated (or alternately, deactivated) by generating a reamer activation (or deactivation) signal 118, which can be received and detected downhole at the reamers 108. The reamer activation signal 118 may be generated at a surface 110 of the wellsite 122, such as at an above-ground location where a human operator and/or control equipment may be located. The activation signal 118 according to this disclosure may comprise any form of a signal that may be communicated and detectable downhole for activating the reamer(s) 108 and distinguishable from other phenomena that are not intended as the activation signal.

The activation signal in at least some examples may comprise an electrical, electromagnetic, or optical signal. The electrical, electromagnetic, or optical signal may be used to at least initiate activation of the reamer(s) 108. In some cases, the activation signal could even be initiated at a remote location 120 and communicated to a wellsite 122 over any suitable communication network 124, e.g., a cloud, Internet, cellular, satellite network, etc., over any suitable transmission medium such as wireless, electromagnetic, fiber optic, and/or electrical transmission medium of any suitable type.

In certain well installations, electrical, electromagnetic, or optical signal pathways can sometimes be provided along the drill string 102 and may be used to communicate the activation signal 118 downhole to the reamer(s) 108 from the surface 110 of the well site. More commonly, however, such electrical, electromagnetic, or optical signal pathways are not available in a drill string. In those cases, the activation signal 118 may still comprise an electrical, electromagnetic, or optical signal to initiate the reamer activation, e.g., at surface 110 or the remote location 120, and the activation signal 118 may further comprise an activation sequence of physically measurable drill string parameters such as flow through and/or rotation of the drill string 102 that is detectable downhole, and unlikely to occur by accident or otherwise which does not indistinguishably resemble some other flow and/or rotational sequence that might occur during routine drill string operation when activation of the reamer is not intended. The activation sequence of flow and/or rotation may include absolute values and/or changes in the flow and/or changes in the rotation. Rotation may include, for example, rotation count, revolutions per minute (RPMs), stop/go patterns, or other detectable parameter related to rotation of the drill string 102. Flow may include, for example, volumetric rate of flow, pressure, or other flow parameter, either absolute values or changes in value. Such an activation sequence may be used to communicate from the surface 110 downhole to the reamer(s) 108 without the need for electrical, electromagnetic, or optical pathways running down the entire drill string 102. The activation sequence may be detected downhole, such as using flow, pressure, and RPM sensors and converted back to an electronic signal. The signal can be analyzed for detecting the predefined activation sequence. Moreover, although the activation sequence set forth above is configured to activate the reamer 108, the activation sequence may be configured to activate any suitable downhole tool.

Figure 2:
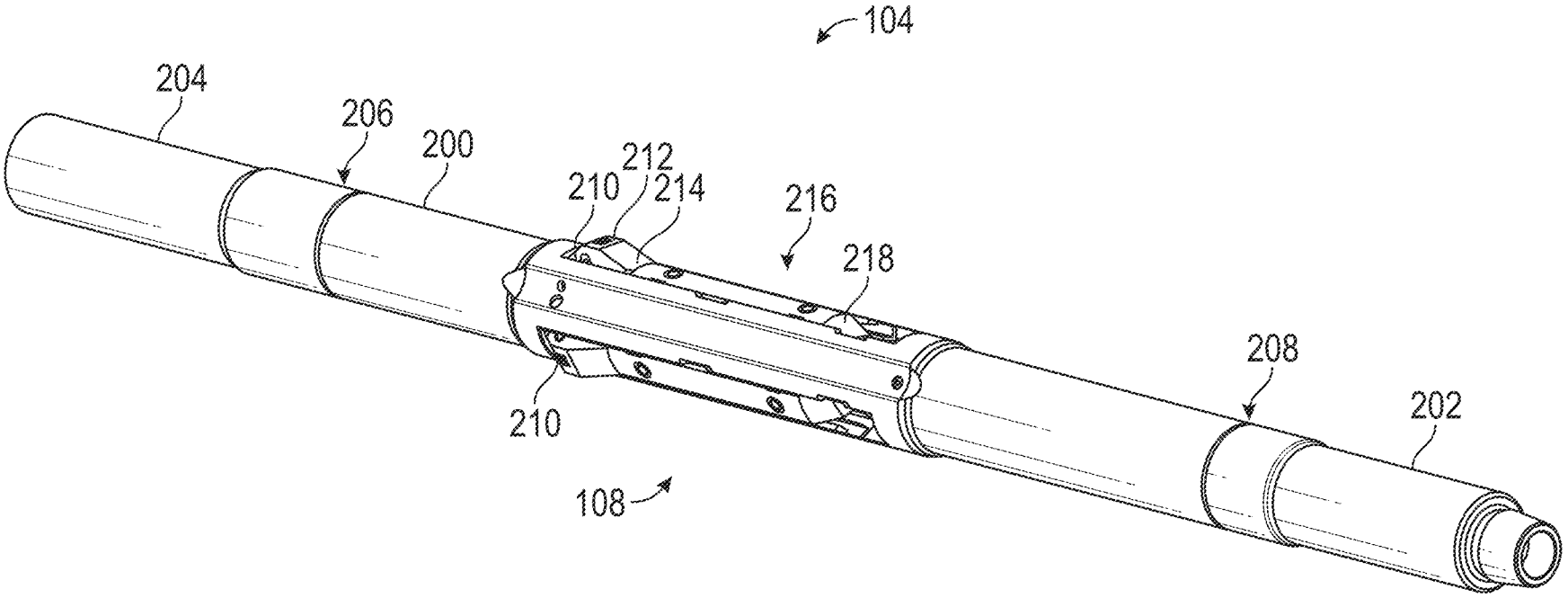
FIG. 2 illustrates a perspective view of a downhole tool in an activated state, in accordance with some embodiments of the present disclosure.

FIG. 2 illustrates a perspective view of a downhole tool in an activated state, in accordance with some embodiments of the present disclosure. As set forth above, the downhole tool 104 may include any suitable downhole tool 104. For example, as illustrated, the downhole tool may include the reamer 108. The reamer 108 includes a reamer body 200 that may support various reamer components. Some reamer components (discussed further below) may be housed within a compartment in the reamer body 200 or a bottom sub 202.

Further, the reamer 108 includes a top sub 204 and the bottom sub 202 on opposing inlet ends 206 and outlet ends 208 of the reamer body 200 provide connections (e.g., threaded connections) to couple the reamer 108 within a drill string. An internal through bore (not explicitly shown) passes from the inlet end 206 to the outlet end 208 to allow flow of downhole fluid and other components or materials along the drill string through the reamer 108. Thus, one or more instances of the reamer 108 may be assembled within a drill string along with other drill string components.

The reamer body 200 optionally includes any number of exterior axial pockets for receiving certain reamer components (e.g., reamer arms, electronic control modules, etc.). For example, the reamer 108 may include reamer arm pockets 210 on the reamer body 200 that contain expandable reamer arms 212. The reamer arms 212 are pivotably secured to the reamer body 200 and may be moved between a retracted position and an extended position in response to activation and deactivation signals. In the retracted position, the reamer arms 212 may be receded at least partially into the reamer arm pockets 210 on the reamer body 200 to help protect the reamer arms 212 as the reamer is tripped in or out of the wellbore prior to or subsequent to a reaming operation. The reamer arms 212 including cutting structures 214 that, when engaged with the wellbore, enlarge the wellbore as the assembly is subsequently rotated through the formation. The reamer arms 212 can be fashioned after a pivoting pin set or a wedge style that rides outward on a track arrangement. A hydraulic reamer arm actuator 216 may include a travel block 218 that transfers axial force to the reamer arms 212 to expand the reamer arms 212 outwardly to engage the surrounding formation, as illustrated.

Figure 3:
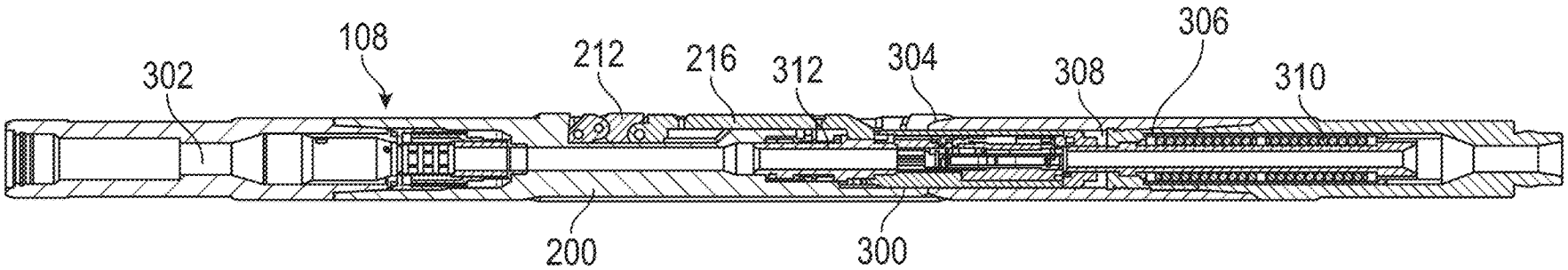
FIG. 3 illustrates a cross-sectional view of the downhole tool in a deactivated state, in accordance with some embodiments of the present disclosure.

FIG. 3 illustrates a cross-sectional view of the downhole tool in a deactivated state, in accordance with some embodiments of the present disclosure. As illustrated, the reamer arm(s) 212 the reamer 108 may be disposed in a retracted position in the deactivated state, such as for tripping in or out of a wellbore or otherwise when not reaming. The reamer arm actuator 216 further includes a piston block assembly 300 inside the reamer body 200 that may be loosely coupled to the travel blocks 218 (shown in FIG. 2). At least some of the pressurized downhole fluid flowing through a primary flow path 302 of the reamer body 200 may be diverted from the reamer body 108 and filtered for use as the working fluid for various reamer components such as the reamer arm actuator 216. The reamer arm actuator 216 further includes a first reamer seal 304 and a second reamer seal 306 that allow the piston block assembly 300 to travel axially inside the reamer body 200 as fluid pressure to the piston block assembly 300 increases. As the piston block assembly 300 responds to the pressure increase, filtered downhole fluid will fill an activation chamber 308 of the hydraulic reamer arm actuator 216. This, in turn, will compress a biasing member (e.g., spring) 310 of the hydraulic reamer arm actuator 216 to expand the reamer arms 212 toward the extended position. A seal packing 312 provides a stationary seal that maintains seal integrity of the piston block assembly 300 inside of the reamer body 200.

Figure 4:
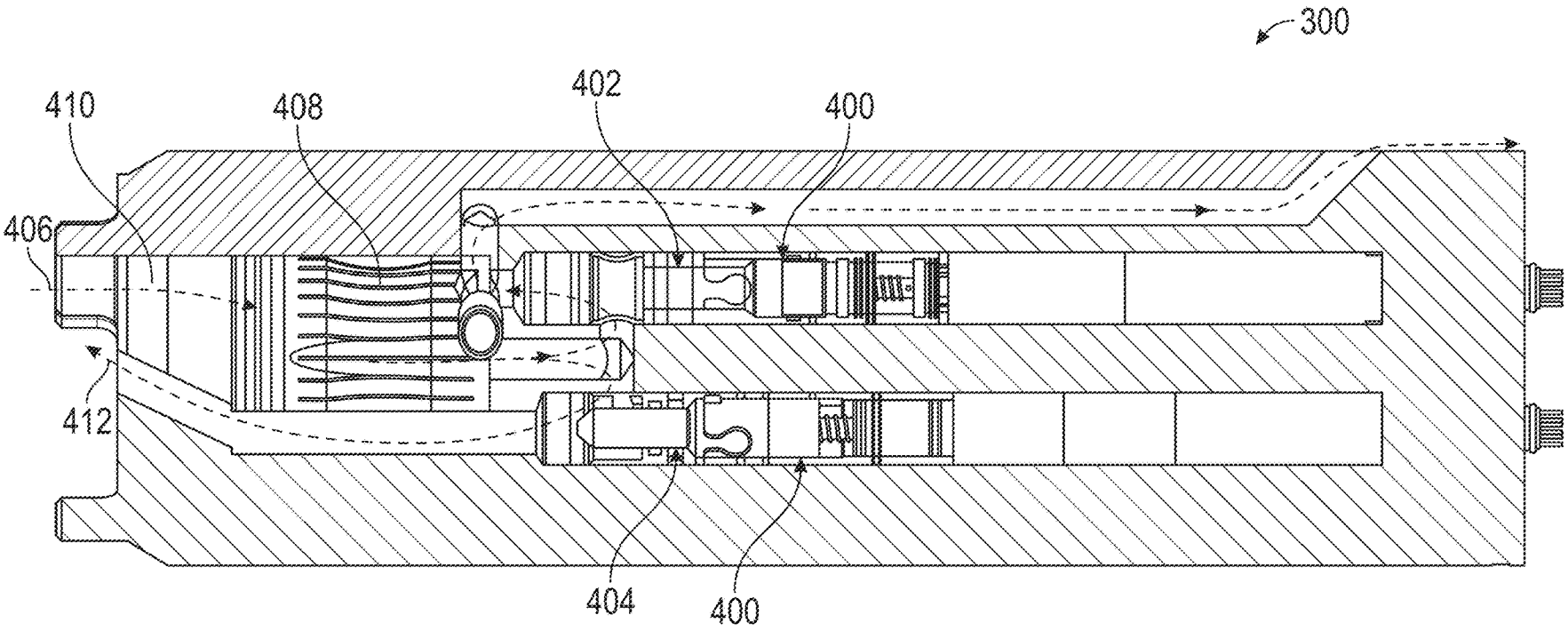
FIG. 4 illustrates a cross-sectional view of a piston block assembly of a downhole tool, in accordance with some embodiments of the present disclosure.

FIG. 4 illustrates a cross-sectional view of a piston block assembly of a downhole tool, in accordance with some embodiments of the present disclosure. The piston block assembly 300 may include a plurality of valve assemblies 400 (e.g., an actuation mechanism 402 for activating the downhole tool 104 (shown in FIG. 1) and a signal generation mechanism 404 for outputting a confirmation signal 50). The valve assemblies 400 may be actuated by an electronic control board 504 (shown in FIG. 5). As illustrated, a downhole fluid 406 may be passed through a filter 408, via a flow path 410, and then supplied to both valve assemblies 400. In response to actuating (e.g., opening) the actuation mechanism 402, the downhole fluid 406 may flow through the actuation mechanism 402 and enter the activation chamber 308 (shown in FIG. 3), which may extend the reamer arms 212 (shown in FIG. 2) as fluid pressure increases. Further, the signal generation mechanism 404 may be actuated by the electronic control board 504. As set forth in greater detail below, the signal generation mechanism 404 may be configured to actuate to generate a predefined pressure signal 412 (e.g., confirmation signal) with the downhole fluid received via the flow path 410. The duration, frequency and amplitude of this predefined pressure signal 412 can be adjusted with the electronic control board 44 and flow rate of the downhole fluid 406.

Figure 5:
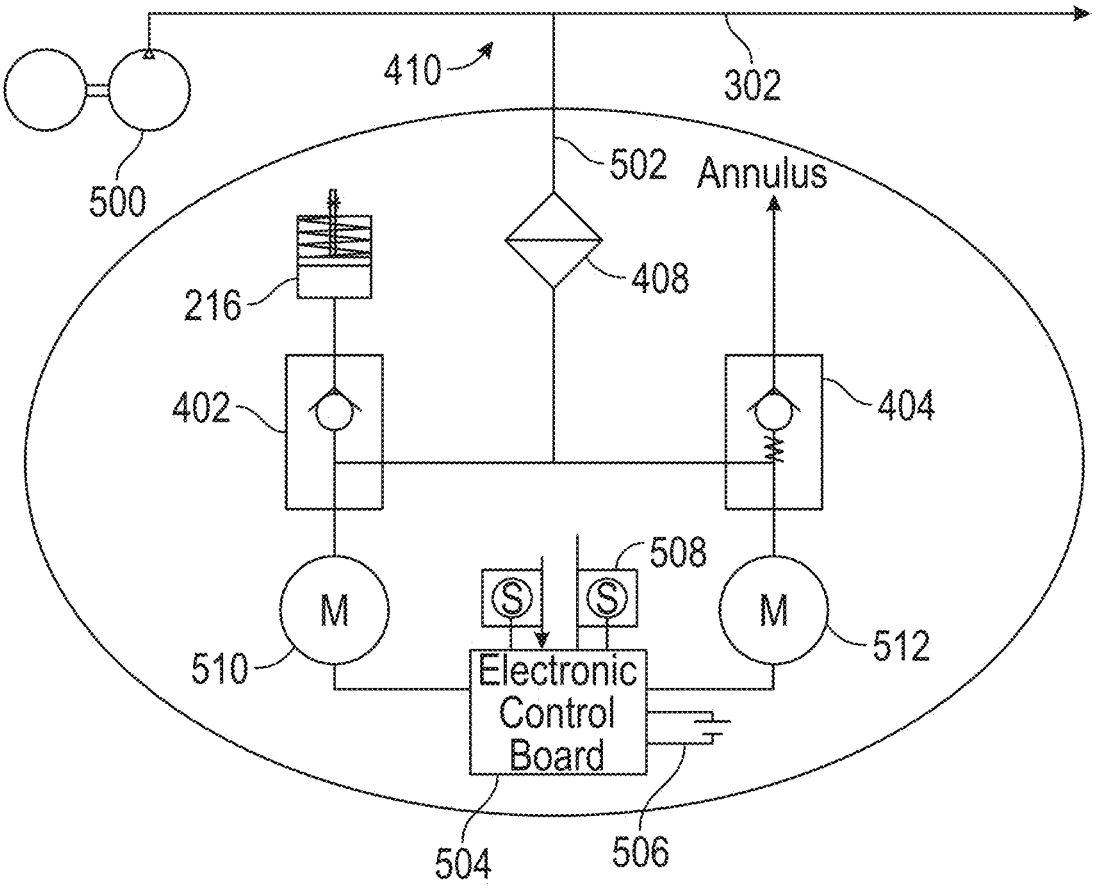
FIG. 5 illustrates a fluid circuit diagram for hydraulic operation of the downhole tool, in accordance with some embodiments of the present disclosure.

FIG. 5 illustrates a fluid circuit diagram for hydraulic operation of the downhole tool, in accordance with some embodiments of the present disclosure. As illustrated, a pump 500, which may include a rig pump that provides the pressurized flow of downhole fluid 406 for downhole use such as for drilling and reamer operation. The bulk of the downhole fluid may be circulated along the flow path 410 (e.g., the primary flow path 302) through the drill string. The pressurized downhole fluid 406 is therefore available all along the drill string and may be used as a working fluid within the hydraulic circuit within the reamer 108 (shown in FIG. 2). Thus, a portion of the downhole fluid is diverted to a secondary flow path 502 of the flow path 410 for use as the working fluid for the reamer 108. The downhole fluid 406 along the secondary flow path 502 is filtered by the filter 408 as it enters the reamer 108.

The electronic control board 504 is located downhole, which may be inside the reamer 108 or a sub connected thereto. The electronic control board 504 may be powered by a downhole electrical power source, such as an on-board battery 506. The electronic control board 504 may monitor a signal input 508 for the activation signal 118 (shown in FIG. 1) from surface. In some cases, the activation signal 118 may be communicated downhole along a transmission path comprising electrical, electromagnetic, optical, and/or optical pathways. In cases where the activation signal 118 is embodied by an activation sequence, various sensors "S" in communication with the electronic control board 504 may detect components of the activation sequence (e.g., flow and RPM) and the electronic control board 504 may detect the activation sequence by matching the activation sequence with a representation of this activation sequence in memory.

In response to receiving the activation signal 118, the electronic control board 504 initiates activation of the actuation mechanism 402 for activating the downhole tool 104 (e.g., the reamer 108) and the signal generation mechanism 404 for generating predefined pressure signal, which may be detectable uphole to confirm the activation of the reamer. In particular, the electronics control board 504 may be configured to output at least one actuation signal to an actuation motor 510 configured to actuate the actuation mechanism 402 and to a signal motor 512 configured to actuate the signal generation mechanism 404.

The actuation mechanism 402 can be any of a variety of valve types, such as a shuttle valve that the electronic control board 504 may open in response to the activation signal. Opening the actuation mechanism 402 supplies pressure from the downhole fluid to a hydraulic reamer arm actuator 216 to actuate the reamer 108.

The pressurized fluid may be supplied in to the signal generation mechanism 404 to confirm the actuation of the reamer arms 212 (shown in FIG. 2). The predefined pressure signal output via the signal generation mechanism 404 may comprise a pulse, such as a negative fluid pulse, that propagates uphole of the reamer 108 and may be detectable uphole of the reamer 108, such as at the surface 110 of the wellsite 122 (shown in FIG. 1).

Confirmation of the reamer activation (or reamer deactivation) may trigger one or more steps, such as to commence (or cease) reaming, or any other step related to reaming, drilling, or other wellbore activities that may or may not involve the use of the drill string 102. For example, it may be desirable to confirm that the reamer arms 212 are activated before performing a reamer operation, which may involve resuming rotation of the drill string 102. As another example, it may be desirable to confirm that the reamer arms 212 are deactivated before tripping out of the wellbore 100.

Figure 6:
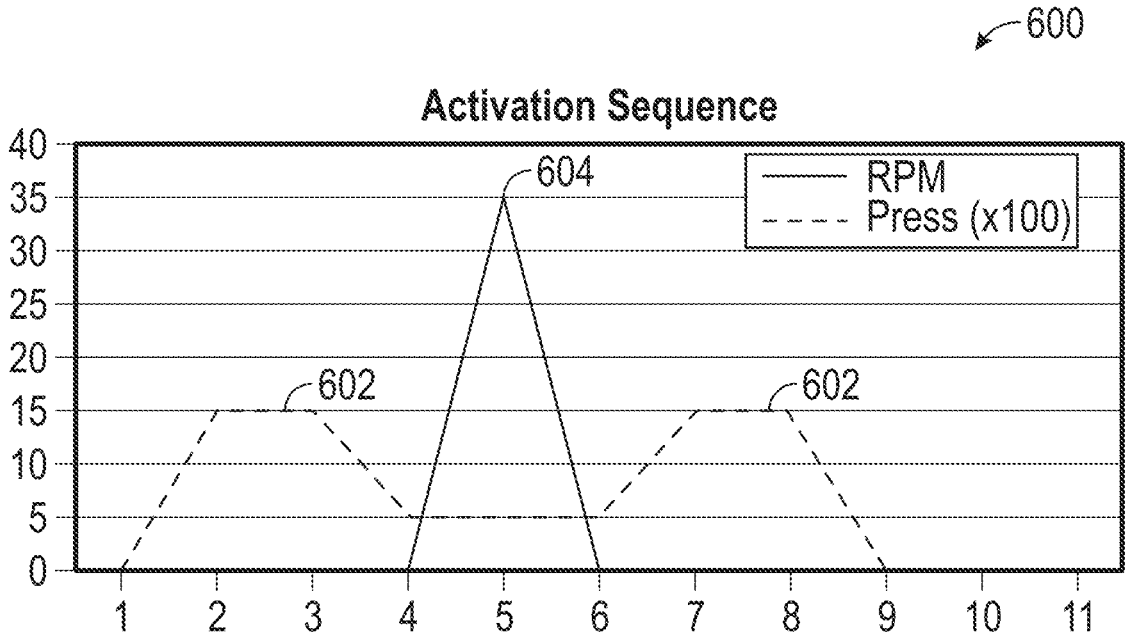
FIG. 6 illustrates a graphical representation of an activation sequence for the downhole tool, in accordance with some embodiments of the present disclosure.

FIG. 6 illustrates a graphical representation of an activation sequence for the downhole tool, in accordance with some embodiments of the present disclosure. As illustrated, the activation sequence 600 received by the electronic control board 504 (e.g., shown in FIG. 5) may include a combination of rotation and flow. The rotation may be expressed in terms of revolutions per minute (RPMs) of the drill string 102 (shown in FIG. 1). The flow may be expressed in terms of a flow pressure of a downhole fluid through the drill string 102 or along the annulus 126 between the drill string 102 and the wellbore 100. In this case, the activation signal is embodied as an activation sequence comprising two pressure rises 602 interspersed with an RPM spike 604. Sensors may be located downhole in the wellbore 100, specifically in the reamer 108 or a controller in communication with the reamer 108, for sensing the activation sequence 600. For example, a pressure sensor may be used to sense the pressure rises 602 and a velocity sensor may be used to sense the RPM spike 604.

Figure 7:
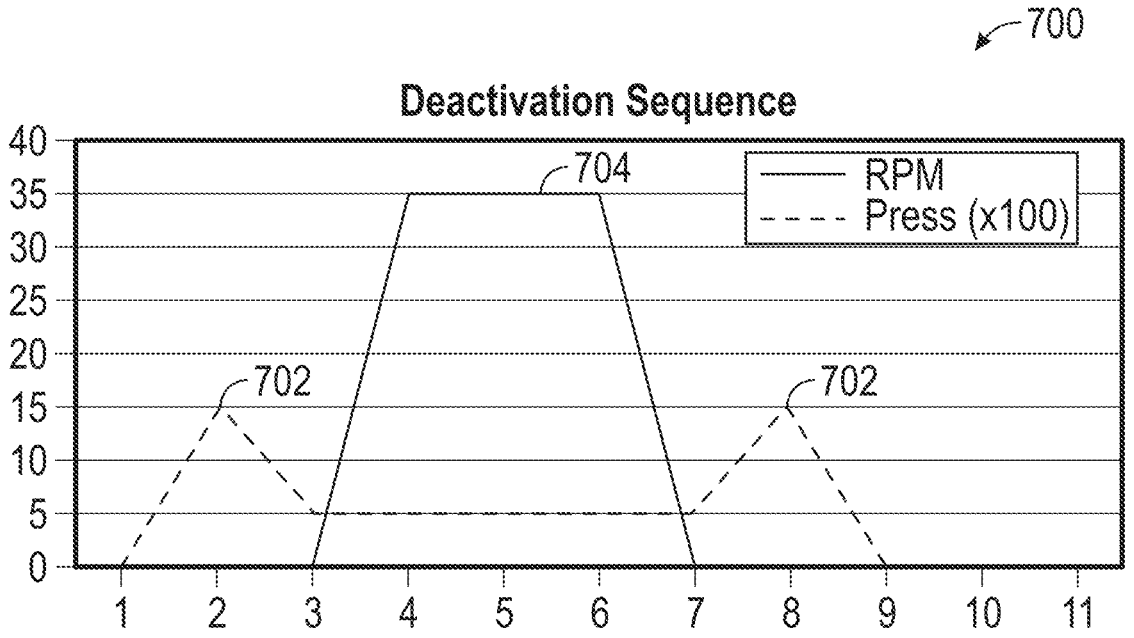
FIG. 7 illustrates a graphical representation of a deactivation sequence for the downhole tool, in accordance with some embodiments of the present disclosure.

FIG. 7 illustrates a graphical representation of a deactivation sequence for the downhole tool, in accordance with some embodiments of the present disclosure. As illustrated, the deactivation sequence 700 received by the electronics control board (e.g., shown in FIG. 5) may also include a combination of rotation and flow. Generally, the deactivation sequence 700 could be substantially the same as the activation sequence, such as for use in a toggle on/off (open/closed) control logic for a reamer. However, as illustrated, the deactivation sequence 700 may include two pressure rises 702 interspersed with an RPM spike 704 that are distinguishable from the activation sequence of FIG. 6.

Figure 8:
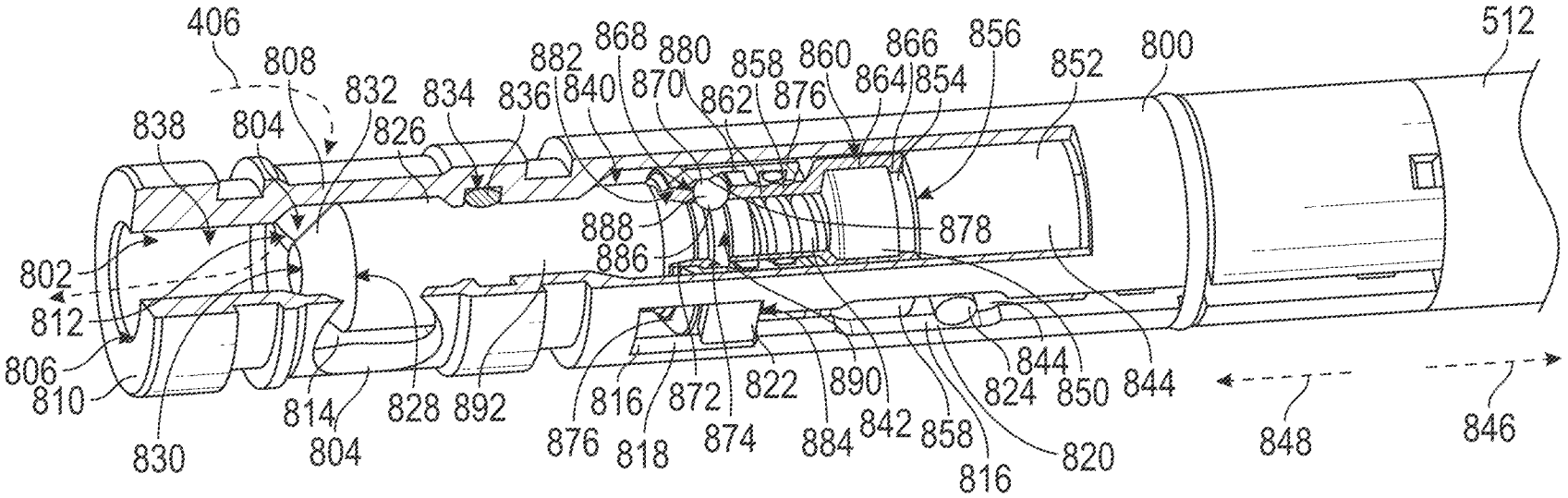
FIG. 8 illustrates a partial cutaway view of a signal generation mechanism in the open position, in accordance with some embodiments of the present disclosure.

FIG. 8 illustrates a partial cutaway view of a signal generation mechanism in the open position, in accordance with some embodiments of the present disclosure. As set forth above, the downhole fluid 406 may flow into the downhole tool 104 (shown in FIG. 3). In particular, the downhole fluid 406 may flow into and through portions of the piston block assembly 300 of the downhole tool 104 (shown in FIG. 4). The signal generation mechanism 404 may be disposed at least partially within the piston block assembly 300 such that the signal generation mechanism 404 may receive at least a portion of the downhole fluid 406 flowing into the piston block assembly 300.

The signal generation mechanism 404 may include a main housing 800 having a central bore 802 configured to receive the downhole fluid 406 via a fluid inlet 804. The main housing 800 may further include a fluid outlet 806 configured to output the downhole fluid 406 from the main housing 800. As illustrated, the main housing 800 may include a generally tubular shape, and the fluid inlet 804 may be formed through a radial wall 808 of the main housing 800. Further, the fluid outlet 806 may be formed at a first axial end 810 of the main housing 800. However, the fluid inlet 804 and the fluid outlet 806 may be formed in any suitable portions of the main housing 800. For example, the fluid outlet 806 may be formed through the radial wall 808 of the main housing 800 and the fluid inlet 804 may be formed at the first axial end 810 of the main housing 800. Alternatively, both the fluid outlet 806 and the fluid inlet 804 may be formed through the radial wall 808 of the main housing 800. Moreover, the fluid outlet 806 and the fluid inlet 804 may be axially offset along the main housing 800.

The main housing 800 may further include a valve seat 812 formed on an inner surface 814 of the main housing 800. As illustrated, the valve seat 812 is disposed between the fluid inlet 804 and the fluid outlet 806. Further, the valve seat 812 may have an annular shape extending about the circumference of the inner surface of the main housing 800. Additionally, the main housing 800 may include at least one lug channel 816 formed in the main housing 800. The at least one lug channel 816 may be formed in the inner surface 814 of the main housing 800. The at least one lug channel 816 may extend partially through the main housing 800. Alternatively, the at least one lug channel 816 may extend through the main housing 800. Moreover, as illustrated, the main housing 800 may include a first lug channel 818 and a second lug channel 820 each formed in the main housing 800. As set forth in greater detail below, the first lug channel 818 may be configured to interface with a release lug 822 and the second lug channel 820 may be configured to interface with a stop lug 824.

The signal generation mechanism 404 further includes a valve plug 826 disposed within the main housing 800. The valve plug 826 is configured to move along the central bore 802 of the main housing 800 between an open position and a closed position. The valve plug 826 may have a generally cylindrical shape with a sealing feature 828 formed at a first axial end 830 of the valve plug 826. The sealing feature 828 may include any suitable shape configured to interface with the valve seat 812. For example, as illustrated, the sealing feature 828 may include a frustoconical shape having a tapered portion 832 configured to interface with the valve seat 812. In the closed position, the valve plug 826 is configured to interface with the valve seat 812 to block fluid flow through the main housing 800. That is, the tapered portion 832 of the valve plug 826 may be configured to seal against the valve seat 812 in the closed position such that the downhole fluid flowing into the main housing 800 via the fluid inlet 804 is blocked from flowing to the fluid outlet 806. In response to the valve plug 826 moving from the closed position toward the open position, the downhole fluid may flow from the fluid inlet 804 to the fluid outlet 806. As set forth in greater detail below, the valve plug 826 may be configured to move into the closed position and back to the open position at desired rates to produce a predefined pulse signal that is detectable at the surface 110 (shown in FIG. 1).

Additionally, the signal generation mechanism 404 may include a seal slot 834 formed in the radially inner surface 814 of the main housing 800 and a chamber seal 836 disposed within the seal slot 834. The chamber seal 836 may include an O-ring or any other suitable type of seal. The chamber seal 836 is configured to form a seal between the valve plug 826 and the main housing 800. Indeed, the central bore 802 of the main housing 800 may include a flow chamber portion 838 for the downhole fluid and a lubricant chamber portion 840 for various components of the signal generation mechanism 404. The chamber seal 836 may be configured to prevent the downhole fluid from flowing into the lubricant chamber portion 840 of the central bore 802 from the flow chamber portion 838.

Moreover, the signal generation mechanism 404 may include a ball screw 842 disposed at least partially within the central bore 802 of the main housing 800. In particular, the ball screw 842 may be disposed within the lubricant chamber portion 840 of the central bore 802. Further, the ball screw 842 may be axially aligned with the valve plug 826. As set forth above, the ball screw 842 may be configured to rotate in response to actuation of a motor (e.g., the signal motor 512). That is, the signal motor 512 may be configured to actuate in response to receiving one or more signals from the electronic control board 504 (shown in FIG. 5).

As illustrated, the signal generation mechanism 404 may also include a ball nut 844 configured to move axially along the ball screw 842. In particular, the ball nut 844 is configured to move in a first axial direction 846 (e.g., away from the valve seat) in response to rotation of the ball screw 842 in a first circumferential direction (e.g., clockwise) and move in a second axial direction 848 (e.g., toward the valve seat) in response to rotation of the ball screw 842 in a second circumferential direction (e.g., counterclockwise). Further, the ball nut 844 may include a substantially cylindrical outer surface. However, as illustrated, the ball nut 844 may include a variable diameter along the axial length of the ball nut 844. In particular, the ball nut 844 may include a nut interface portion 850 and a nut base portion 852 separated by an anchor channel portion 854. The nut interface portion 850 may have a greater diameter than the anchor channel portion 854, but a smaller diameter than the nut base portion 852. As such, an anchor channel 856 may be formed in the space about the anchor channel portion 854 and between the nut interface portion 850 and the nut base portion 852.

The signal generation mechanism 404 may include the stop lug 824 extending radially outward from the ball nut 844. In particular, the stop lug 824 may extend radially outward from the nut base portion 852 of the ball nut 844. However, the stop lug 824 may extend radially outward from any suitable portion of the ball nut 844. As illustrated, the stop lug 824 is configured to extend into the second lug channel 820 formed in the main housing 800. The stop lug 824 may be configured to interface with the second lug channel 820 to maintain a desired orientation of the ball nut 844 with respect to the main housing 800.

Moreover, signal generation mechanism 404 may include a ball housing insert 858 having an anchor end 860 and a retainer end 862. As illustrated, the anchor end 860 has a generally annular shape and may be secured to the ball nut 844. Specifically, the anchor end 860 may be secured about the nut interface portion 850 and the anchor channel portion 854 of the ball nut 844. The anchor end 860 of the ball housing insert 858 may include an insert recessed portion 864 and an insert lip 866. The insert recessed portion 864 may be disposed about the nut interface portion 850 such that the nut interface portion 850 is at least partially disposed within the insert recessed portion 864. Further, the insert lip 866 may be disposed within the anchor channel 856. Accordingly, the interface between the anchor end 860 and the ball nut 844 may rigidly secure the ball housing insert 858 to the ball nut such that the ball housing insert 858 is configured to move in response to movement of the ball nut 844. Alternatively, the ball housing insert 858 and the ball nut 844 may include any suitable interface for rigidly securing the ball housing insert 858 to the ball nut 844. Further, the ball housing insert 858 and the ball nut 844 may alternatively form a single component.

As set forth above, the ball housing insert 858 also includes the retainer end 862 having a generally annular shape. The retainer end 862 may extend axially away from the ball nut 844 in the direction toward the valve seat 812. As illustrated, at least a portion of the retainer end 862 is disposed about the valve plug 826 in the open position. The retainer end 862 includes a ball slot 868 configured to house at least one ball 870. Also, for reasons set forth below, the ball slot 868 may extend radially through the retainer end 862 from an inner insert surface 872 to an outer insert surface 874.

Moreover, the signal generation mechanism 404 may also include a ball release collar 876 having a generally annular shape. As illustrated, the ball release collar 876 may be disposed at least partially about the ball housing insert 858. In particular, the ball release collar 876 may be disposed about the retainer end 862 of the ball housing insert 858. The ball release collar 876 may include a shallow channel 878 and a deep channel 880 each formed in an inner collar surface 882 of the ball release collar 876. The shallow channel 878 may be axially offset from the deep channel 880. Further, the deep channel 880 may be formed in the ball release collar 876 in a position such that the deep channel 880 is positioned between the shallow channel 878 and the anchor end 860 of the ball housing insert 858 with the ball release collar 876 disposed about the ball housing insert 858. Moreover, the ball release collar 876 is configured to move along the ball housing insert 858 between a holding position and a release position. As set forth in greater detail below, the shallow channel may be aligned with the ball slot 868 in the holding position, and the deep channel 880 may be aligned with the ball slot 868 in the release position.

The signal generation mechanism 404 may also include the release lug 822 extending radially outward from the ball release collar 876. As illustrated, the release lug 822 is configured to extend into the first lug channel 818 formed in the main housing 800. The release lug 822 may be configured to move the ball release collar 876 from the holding position to the release position in response to contacting a first end 884 of the first lug channel 818. That is, the release lug 822 contacting the first end of the first lug channel 818 may restrain axial movement of the ball release collar 876 with respect to the main housing 800. However, the ball nut 844 and the ball housing insert 858 may continue to move in the first axial direction 846. As such, the ball housing insert 858 may move with respect to the ball release collar 876 such that the ball release collar 876 moves from the holding position to the release position.

Moreover, as set forth above, the at least one ball 870 may be disposed at least partially within the ball slot 868 of the ball housing insert 858. The at least one ball 870 is configured to secure the valve plug 826 to the ball housing insert 858 with the ball release collar 876 in the holding position. In particular, the diameter of the at least one ball 870 may be larger than the depth of the ball slot 868 such that a first portion 886 of the at least one ball 870 extends radially inward from the ball slot 868 and a second portion 888 of the at least one ball 870 extends radially outward from the ball slot 868. As illustrated, the valve plug 826 may include an anchor groove 890 formed in a radially outer surface 892 of the valve plug 826. The first portion 886 of the at least one ball 870 may be disposed within the anchor groove 890. Further, the contact between the second portion 888 of the at least one ball 870 and the shallow channel 878 of the ball release collar 876 may hold the at least one ball 870 within the anchor groove 890 in the holding position. The interface between the at least one ball 870 and the anchor groove 890 may be configured to restrain axial movement of the valve plug 826 with respect to the ball housing insert 858. Indeed, the at least one ball 870 may secure the valve plug 826 to the ball housing insert 858.

However, the at least one ball 870 is configured to move radially outward from the anchor groove 890 to release the valve plug 826 in response to the ball release collar 876 moving from the holding position to the release position. Indeed, in the holding position, the deep channel 880 of the ball release collar 876 may be aligned with the ball slot 868 such that the at least one ball 870 may move radially outward, which may permit the first portion 886 of the at least one ball 870 to move radially outward from the anchor groove 890. Moving the at least one ball out 870 of the anchor groove 890 may release the valve plug 826 from the ball housing insert 858 since the interface between the at least one ball 870 and the anchor groove 890 no longer restrains axial movement of the valve plug 826 with respect to the ball housing insert 858.

Figure 9:
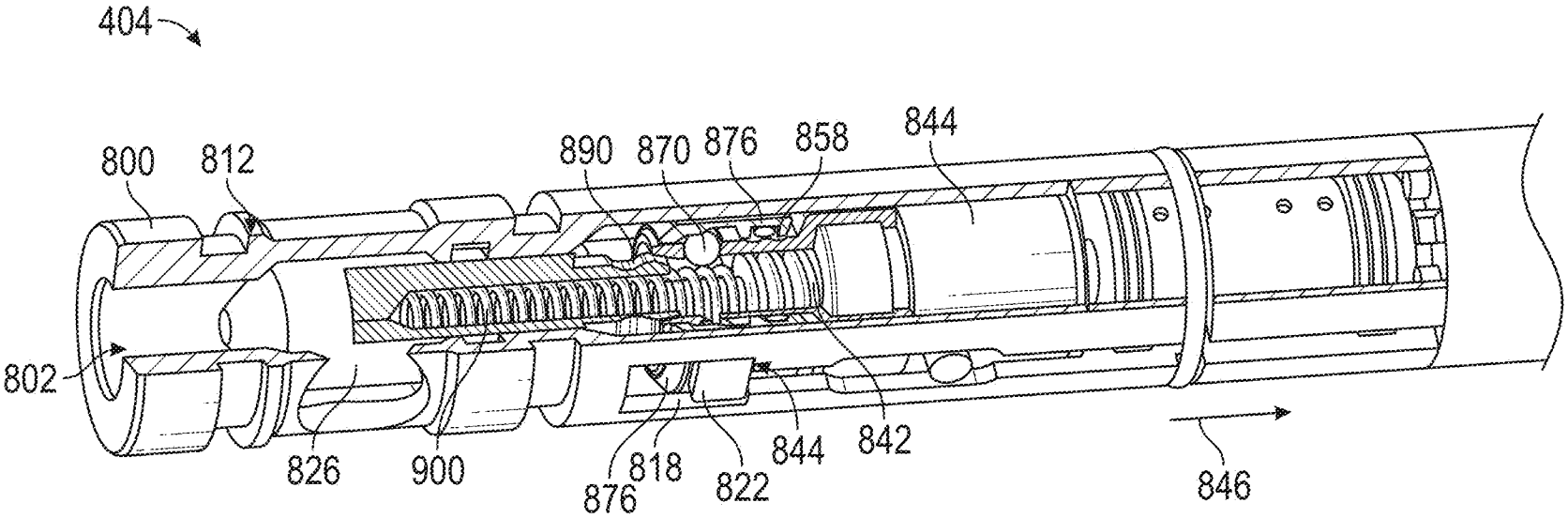
FIG. 9 illustrates a partial cutaway view of a signal generation mechanism in the closed position, in accordance with some embodiments of the present disclosure.

FIG. 9 illustrates a partial cutaway view of a signal generation mechanism in the closed position, in accordance with some embodiments of the present disclosure. As set forth above, continued movement of the ball nut 844 and the ball housing insert 858 in the first axial direction 846 after the release lug 822 contacts the first end 884 of the first lug channel 818 may drive the ball release collar 876 to move from the holding position to the release position. Further, as illustrated, the at least one ball 870 may be configured to move radially outward from the anchor groove 890 to release the valve plug 826 in response to the ball release collar 876 moving from the holding position to the release position.

The signal generation mechanism 404 may also include a spring 900 configured to drive the valve plug 826 from the open position to the close position in response to the at least one ball 870 releasing the valve plug 826. That is, as illustrated, the spring 900 may be configured to drive the valve plug 826 into the valve seat 812 to block fluid flow through the central bore 802 of the main housing 800. The spring 900 may include any suitable type of spring. For example, as illustrated, the spring 900 may include a compression spring. Further, as illustrated, a first end of the spring 900 may be disposed at least partially within valve plug 826 such that the spring 900 is coaxial with the valve plug 826. A second end of the spring 900 may be configured to contact a portion of the ball screw 842. However, the second end of the spring 900 may be configured to contact any suitable portion of the signal generation mechanism 404.

Moreover, the spring 900 may be configured to move the valve plug 826 at a faster rate than the ball screw 842. Indeed, as set forth in greater detail below, the spring 900 is configured to drive the valve plug 826 from the open position to the closed position, and the ball screw 842 is configured to drive the valve plug 826 from the closed position to the open position. Having the spring 900 move the valve plug 826 to the closed position at a higher rate than the ball screw 842 moves the valve plug 826 to the open position may generate a particular pressure pulse signal.

Figure 10:
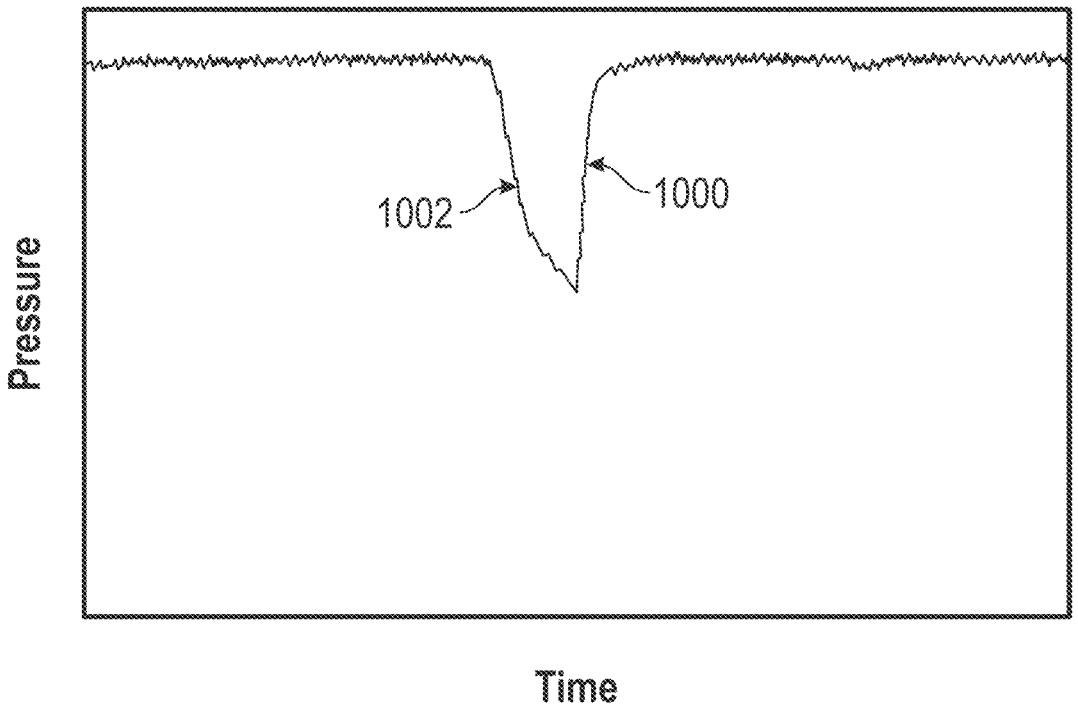
FIG. 10 illustrates a graphical representation of a confirmation signal output via the signal generation mechanism, in accordance with some embodiments of the present disclosure.

FIG. 10 illustrates a graphical representation of a confirmation signal output via the signal generation mechanism, in accordance with some embodiments of the present disclosure. As set forth above, the spring may be configured to move the valve plug to the closed position at a higher rate than the ball screw is configured to the valve plug to the open position, which may generate a particular pressure signal. Indeed, the valve plug may be configured to move into the closed position and back to the open position at desired rates to produce a predefined pressure signal that is detectable at the surface. The predefined pressure signal may provide confirmation at surface of successful activation of the downhole tool.

As illustrated, the pressure detected at surface may decrease (e.g., first slope 1002) in response to the ball screw moving the valve plug to the open position. As the ball release collar 876 moves to the release position, the valve plug is released, and the spring rapidly moves the valve plug from the open position to the closed position. In response to the valve plug moving to the closed position, a resultant pressure increase (e.g., second slope 1000) occurs. The slope 1002 (variable duration) is controlled by the motor speed. This allows for a unique pulse signature (e.g., the predefined pressure signal) to be created, which may ensure reliable detection on surface.

Figure 11:
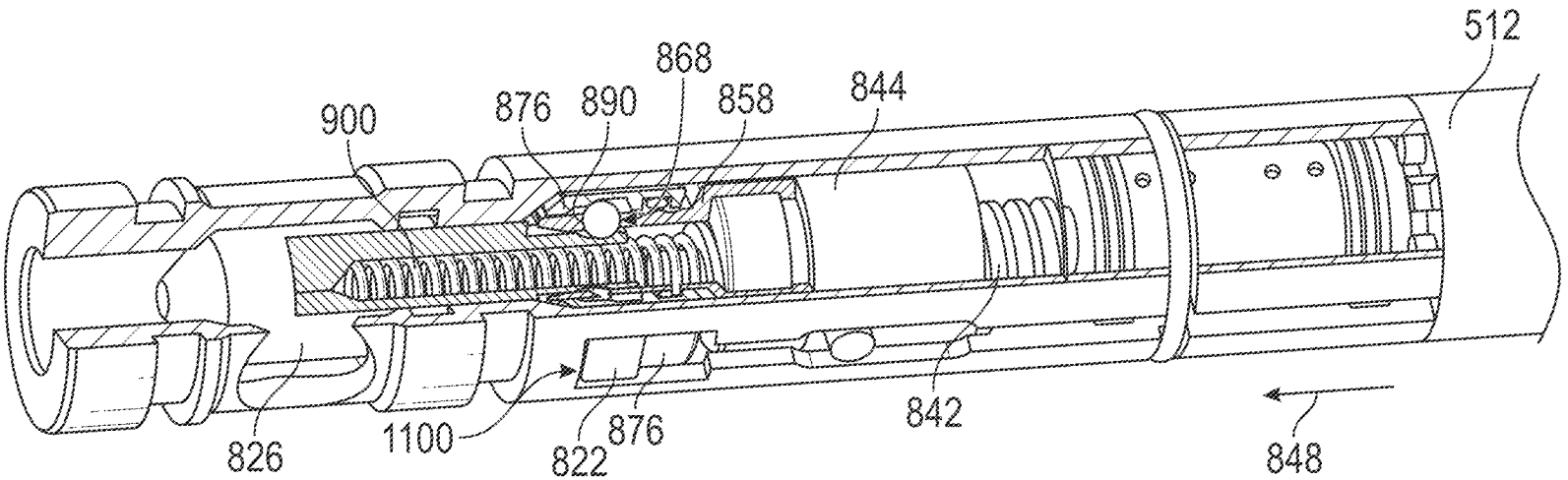
FIG. 11 illustrates a partial cutaway view of a ball screw of the signal generation mechanism driving a ball housing insert to re-connect to the valve plug, in accordance with some embodiments of the present disclosure.

FIG. 11 illustrates a partial cutaway view of a ball screw of the signal generation mechanism driving a ball housing insert to re-connect to the valve plug, in accordance with some embodiments of the present disclosure. As set forth above, the valve plug 826 may be released from the ball housing insert 858 and driven into the closed position via the spring 900. In response to the valve plug 826 moving to the closed position, the signal motor 512 may be reversed to move the ball nut 844 axially along the ball screw 842 in the second axial direction 848 (e.g., toward the valve seat) to re-connect the ball housing insert 858 to the valve plug 826. In particular, the ball nut 844 may be configured to move axially along the ball screw 842 to align to the ball slot 868 of the ball housing insert 858 with the anchor groove 890 of the valve plug 826.

However, as illustrated, the release lug 822 of the ball release collar 876 may be configured to contact a second end 1100 of the first lug channel 818 prior to the ball slot 868 aligning with the anchor groove 890. The contact between the release lug 822 and the second end 1100 of the first lug channel 818 may restrain axial movement of the ball release collar 876 in the second axial direction 848. As set forth in greater detail below, continued movement of the ball nut 844 and the ball housing insert 858, via the ball screw 842, may drive the ball slot 868 into alignment with the anchor groove 890 and move the ball release collar 876 into the holding position with respect to the ball housing insert 858.

Figure 12:
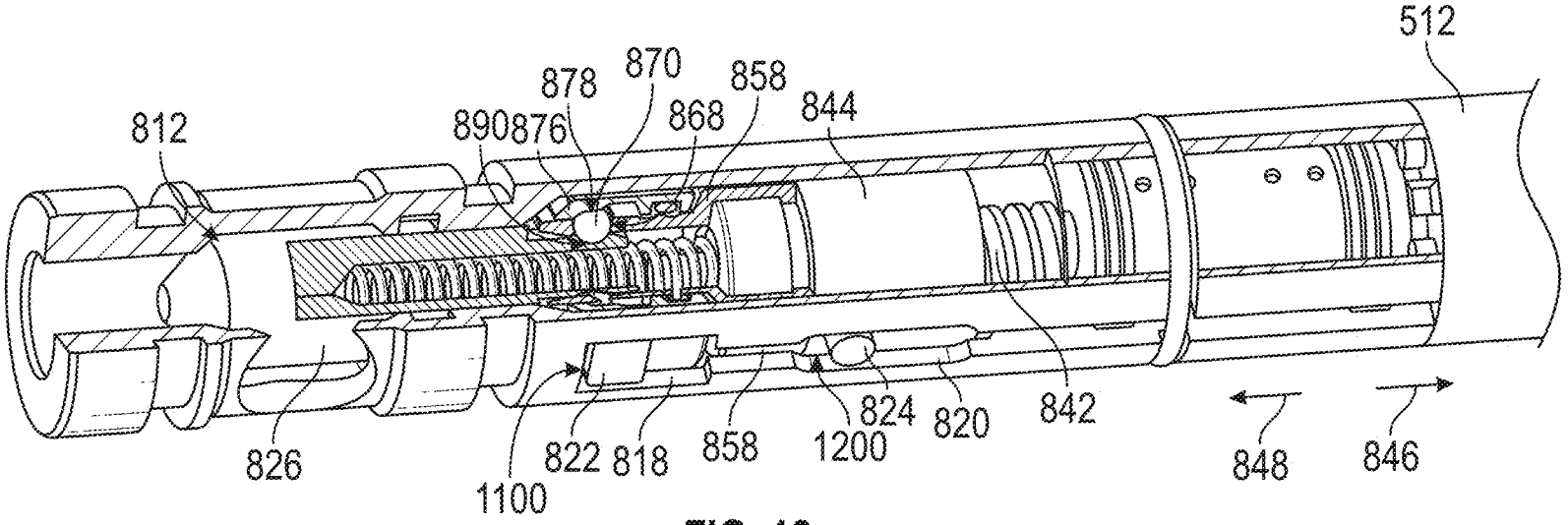
FIG. 12 illustrates a partial cutaway view of the ball housing insert reconnected to the valve plug, in accordance with some embodiments of the present disclosure.

FIG. 12 illustrates a partial cutaway view of the ball housing insert reconnected to the valve plug, in accordance with some embodiments of the present disclosure. As set forth above, the ball screw 842 may continue to drive the ball nut 844 and the ball housing insert 858 in the second axial direction 848 after the release lug 822 contacts the second end 1100 of the first lug channel 818. Indeed, the ball housing insert 858 may continue to move in the second axial direction 848 (e.g., toward the valve seat 812) until the ball slot 868 is axially aligned with the anchor groove 890. As illustrated, the ball release collar 876 may also move into the holding position with respect to the ball housing insert 858 in response to continued movement of the ball housing insert 858. As such, the shallow channel 878 of the ball release collar 876 may be aligned with the ball slot 868 to drive the at least one ball 870 into the anchor groove 890 of the valve plug 826, which may secure the valve plug 826 to the ball housing insert 858.

Moreover, the stop lug 824 may be configured to restrain axial movement of the ball nut 844 in second axial direction 848 in response to contacting a second end 1200 of the second lug channel 820. The second lug channel 820 may be formed such that the stop lug 824 of the ball nut 844 may be configured to restrain movement of the ball nut 844 in the second axial direction 848 once the ball slot 868 is aligned with the anchor groove 890 and the ball release collar 876 is in the holding position.

In response to the valve plug 826 reconnecting to ball housing insert 858, the signal motor 512 may be reversed to move the ball nut 844 and the ball housing insert 858 axially along the ball screw 842 in the first axial direction 846 (e.g., away from the valve seat 812). Moving the ball nut 844 and the ball housing insert 858 in the first axial direction 846 may move the valve plug 826 from the closed position to the open position.

Figure 13:
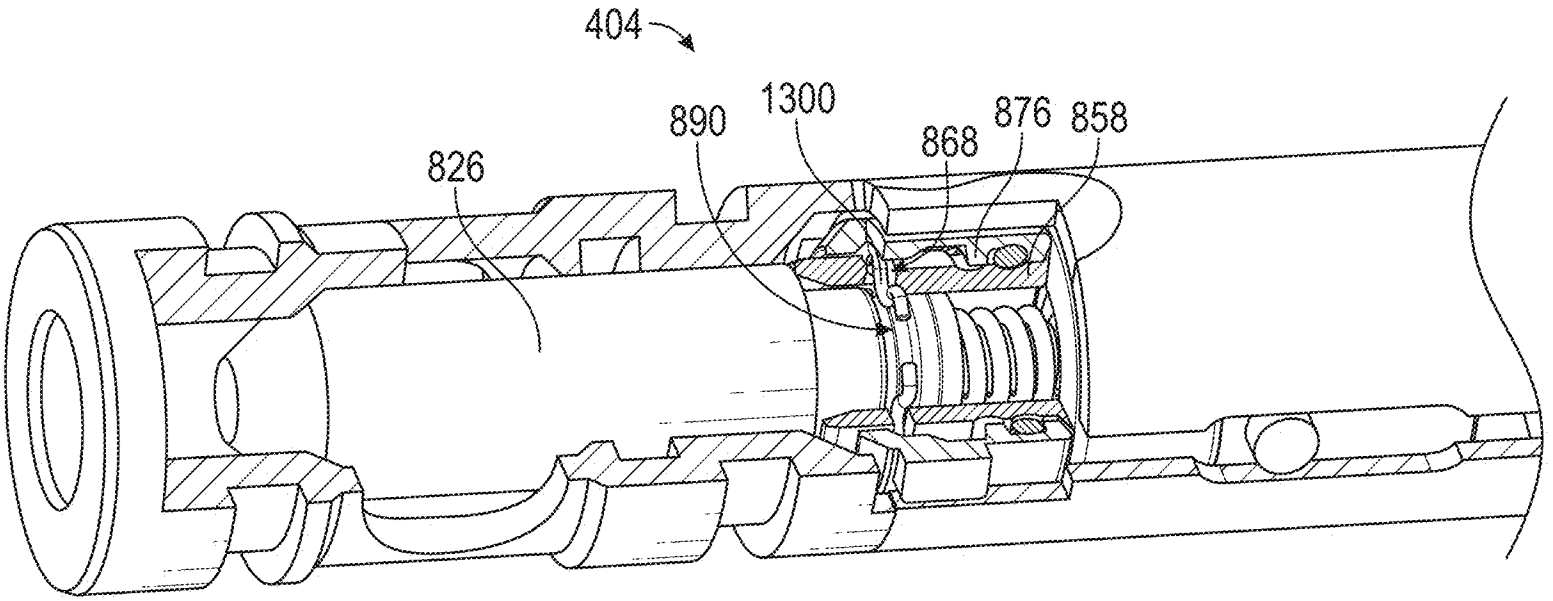
FIG. 13 illustrates a perspective view of a wire ring feature of the signal generation mechanism with the ball release collar in the holding position.

FIG. 13 illustrates a perspective view of a wire ring feature of the signal generation mechanism with the ball release collar in the holding position, in accordance with some embodiments of the present disclosure. As set forth above, the at least one ball 870 may be disposed at least partially within the ball slot 868 of the ball housing insert 858 (shown in FIG. 8). Alternatively, as illustrated, the signal generation mechanism 404 may include a wire ring feature 1300 disposed at least partially within the ball slot 868 of the ball housing insert 858. Further, the wire ring feature 1300 may be configured to interface with the anchor groove 890 of the valve plug 826 and the ball release collar 876 to secure the valve plug 826 to the ball housing insert 858 in the holding position and release the valve plug 826 from the ball release collar 876 in the release position. In particular, the wire ring feature 1300 may include a compliant material configured to elastically deform to engage the anchor groove 890 of the valve plug 826 in response to interfacing with the ball release collar 876 in the holding position. In particular, the wire ring feature 1300 may be configured to elastically deform (e.g., bend) radially inward to move into the anchor groove 890, in response to interfacing with the ball release collar 876. Further, moving the wire ring feature 1300 into the anchor groove 890 may secure the valve plug 826 to the ball housing insert 858 due to the interface between the wire ring feature 1300 and the anchor groove 890 of the valve plug 826.

Moreover, the signal generation mechanism 404 may include any suitable latching feature (e.g., the at least one ball 870, cube, plunger, key, etc.) configured to interface with the anchor groove 890 of the valve plug 826 and the ball release collar 876 to secure and release the valve plug 826 from the ball housing insert 858 during operations.

Figure 14:
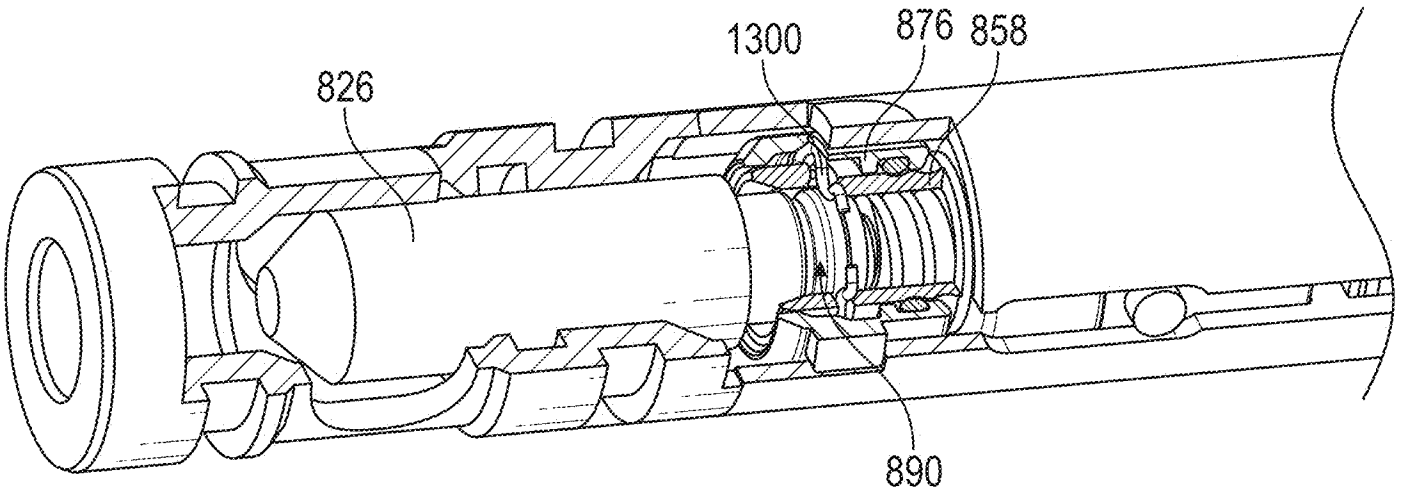
FIG. 14 illustrates a perspective view of a wire ring feature with the ball release collar in the release position, in accordance with some embodiments of the present disclosure.

FIG. 14 illustrates a perspective view of a wire ring feature with the ball release collar in the release position, in accordance with some embodiments of the present disclosure. As set forth above, the wire ring feature 1300 may include the compliant material configured to elastically deform to engage the anchor groove 890 of the valve plug 826 in response to interfacing with the ball release collar 876 in the holding position.

As illustrated, in response to the ball release collar 876 moving to the release position, the wire ring feature 1300 may be configured to rebound to its original shape, such that the wire ring feature 1300 may move radially outward from the anchor groove 890 of the valve plug 826. Further, similar to FIG. 9, moving the wire ring feature 1300 radially outward from the anchor groove 890 may release the valve plug 826 from the ball housing insert 858 such that the valve plug 826 may be driven by the spring 900 (shown in FIG. 9) from the open position to the closed position.

Accordingly, the present disclosure may provide a signal generation system configured to output a predefined pressure pulse to surface to indicate actuation of the downhole tool. The systems and methods may include any of the various features disclosed herein, including one or more of the following statements.

Statement 1. A downhole signal generation system, comprising: a main housing having a central bore configured to receive downhole fluid via a fluid inlet and output the downhole fluid via a fluid outlet, and wherein the main housing includes a valve seat disposed between the fluid inlet and the fluid outlet; a valve plug configured to move along the central bore between an open position and a closed position, wherein the valve plug is configured to interface with the valve seat in the closed position to block fluid flow through the main housing; a ball housing insert disposed at least partially about the valve plug in the open position, and wherein the ball housing insert includes a ball slot; a ball release collar having a shallow channel and a deep channel each formed in an inner surface of the ball release collar, wherein the ball release collar is configured to move along the ball housing insert between a holding position with the shallow channel aligned with the ball slot and a release position with the deep channel aligned with the ball slot; at least one ball disposed at least partially within the ball slot of the ball housing insert, wherein the at least one ball is configured to secure the valve plug to the ball housing insert with the ball release collar in the holding position, and wherein the at least one ball is configured to move to release the valve plug in response to the ball release collar moving from the holding position to the release position; and a spring configured to drive the valve plug from the open position to the closed position in response to the at least one ball releasing the valve plug.

Statement 2. The downhole signal generation system of statement 1, further comprising a ball screw configured to rotate in response to actuation of a motor and a ball nut configured to move axially along the ball screw in a first axial direction in response to rotation of the ball screw in a first circumferential direction, and wherein the ball housing insert includes an anchor end and a retainer end, wherein the anchor end is rigidly secured to the ball nut such that the ball housing insert is configured to move in response to movement of the ball nut.

Statement 3. The downhole signal generation system of statement 1 or statement 2, wherein the ball screw is at least partially disposed within the central bore, and wherein the ball screw is axially aligned with the valve plug.

Statement 4. The downhole signal generation system of any preceding statement, wherein the retainer end extends axially away from the ball nut in a direction toward the valve seat, wherein at least a portion of the retainer end is disposed about the valve plug in the open position, wherein the retainer end includes the ball slot, and wherein the ball slot extends radially through the retainer end.

Statement 5. The downhole signal generation system of any preceding statement, further comprising a lug channel formed in the main housing and a release lug extending radially outward from the ball release collar, wherein the release lug is configured to extend into the lug channel formed in the main housing, wherein the release lug is configured to move the ball release collar from the holding position to the release position in response to contacting a first end of the lug channel, and wherein the release lug is configured to contact the first end of the lug channel in response to movement of the ball nut in the first axial direction.

Statement 6. The downhole signal generation system of any preceding statement, wherein the ball nut configured to move axially along the ball screw in a second axial direction to re-connect the housing insert to the valve plug in response to the valve plug actuating from the open position to the closed position.

Statement 7. The downhole signal generation system of any preceding statement, wherein the ball nut is configured to move axially along the ball screw to drive the ball housing insert in a second axial direction to align to the ball slot of the ball housing insert with an anchor slot of the valve plug in response to the valve plug actuating from the open position to the closed position, and wherein a release lug of the ball release collar is configured to move the ball release collar from the release position to the holding position in response to contacting a second end of a lug channel, and wherein the release lug is configured to contact the second end of the lug channel in response to movement of the ball nut in the second axial direction.

Statement 8. The downhole signal generation system of any preceding statement, wherein the at least one ball is configured to secure the valve plug to the ball housing insert in the closed position in response to the ball release collar moving to the holding position, wherein the ball nut is configured to move axially along the ball screw to drive the ball housing insert in the first axial direction to move the valve plug from the closed position to the open position in response to the at least one ball securing the valve plug to the ball housing insert in the closed position.

Statement 9. The downhole signal generation system of any preceding statement, wherein the spring is configured to drive the valve plug from the open position to the closed position at a faster rate than the ball screw is configured to move the valve plug from the closed position to the open position to generate a predefined pressure pulse signal.

Statement 10. The downhole signal generation system of any preceding statement, wherein the valve plug includes a sealing surface configured to interface with the valve seat, and wherein the valve plug includes an anchor groove configured to receive the at least one ball in the closed position.

Statement 11. The downhole signal generation system of any preceding statement, wherein the valve plug includes an anchor groove formed in a radially outer surface of the valve plug, wherein an inner surface of the shallow channel of the ball release collar is configured to hold the at least one ball within the anchor groove and the ball slot in the holding position, and wherein an interface between the at least one ball and the anchor groove is configured to restrain axial movement of the valve plug with respect to the ball housing insert.

Statement 12. The downhole signal generation system of any preceding statement, wherein the at least one ball is configured to move radially outward from the anchor groove and at least partially into the deep channel of the ball release collar in response to the ball release collar moving from the holding position to the release position.

Statement 13. The downhole signal generation system of any preceding statement, further comprising a seal slot formed in a radially inner surface of the main housing and a seal disposed within the seal slot, wherein the seal is configured to form a seal between the valve plug and the main housing.

Statement 14. The downhole signal generation system of any preceding statement, wherein the fluid inlet is formed through a radially outer surface of the main housing, and wherein the fluid outlet is formed at a first axial end of the main housing.

Statement 15. The downhole signal generation system of any preceding statement, wherein the valve seat is formed in the central bore between the first axial end of the main housing and the fluid inlet, wherein the valve seat extends radially inward from an inner surface of the main housing, and wherein the valve seat is configured to interface with the valve plug in the closed position to seal flow through the central bore at the valve seat.

Statement 16. The downhole signal generation system of any preceding statement, further comprising a downhole tool housing having a flow path, wherein fluid flow is configured to flow into the main housing from the flow path, and wherein the downhole tool includes an actuation mechanism configured to receive fluid flow from the flow path to actuate a downhole tool.

Statement 17. A downhole signal generation system, comprising: a main housing having a central bore configured to receive downhole fluid via a fluid inlet formed in the main housing and output the downhole fluid via a fluid outlet formed in the main housing, and wherein the main housing includes a valve seat disposed between the fluid inlet and the fluid outlet; a lug channel formed in the main housing; a valve plug disposed within the central bore, wherein the valve plug is configured to move along the central bore between an open position and a closed position, wherein the valve plug is configured to interface with the valve seat in the closed position to block fluid flow through the main housing from the fluid inlet to the fluid outlet; a ball screw configured to rotate in response to actuation of a motor; a ball nut configured to move axially along the ball screw in a first axial direction in response to rotation of the ball screw; a ball housing insert having an anchor end and a retainer end, wherein the anchor end is secured to the ball nut, wherein at least a portion of the retainer end is disposed about the valve plug in the open position, and wherein the retainer end includes a ball slot; a ball release collar disposed at least partially about the ball housing insert, wherein the ball release collar includes a shallow channel and a deep channel each formed in an inner surface of the ball release collar, and wherein the ball release collar is configured to move along the ball housing insert between a holding position with the shallow channel aligned with the ball slot and a release position with the deep channel aligned with the ball slot; a release lug extending radially outward from the ball release collar and into the lug channel formed in the main housing, wherein the release lug is configured to move the ball release collar from the holding position to the release position in response to contacting a first end of the lug channel; at least one ball disposed at least partially within the ball slot of the ball housing insert, wherein the at least one ball is configured to secure the valve plug to the ball housing insert with the ball release collar in the holding position, and wherein the at least one ball is configured to move to release the valve plug in response to the ball release collar moving from the holding position to the release position; and a spring disposed between the ball nut and the valve plug, wherein the spring is configured to drive the valve plug from the open position to the closed position in response to the at least one ball releasing the valve plug.

Statement 18. The downhole signal generation system of statement 17, further comprising a second lug channel formed in the main housing and a stop lug extending radially outward from the ball nut, wherein the stop lug is configured to extend into the second lug channel formed in the main housing, wherein the stop lug is configured to restrain axial movement of the ball nut in the first axial direction in response to contacting a first end of the second lug channel and restrain axial movement of the ball nut in a second axial direction in response to contacting a second end of the second lug channel.

Statement 19. The downhole signal generation system of statement 17 or statement 18, further comprising an electronic control board configured to output an actuation signal to the motor, wherein the motor is configured to drive rotation of the ball screw in response to receiving the actuation signal.

Statement 20. A downhole system, comprising: a downhole tool housing having a flow path, wherein fluid flow is configured to flow into the downhole tool housing via the flow path; an electronic control board disposed within the downhole tool housing and configured to output an actuation signal; an actuation mechanism disposed within the downhole tool housing and configured to receive the fluid flow from the flow path for actuating a downhole tool, wherein the actuation mechanism is configured to actuate the downhole tool from a first state to a second state; a signal generator housing disposed within the downhole tool housing, wherein the signal generator includes a main housing having a central bore configured to receive downhole fluid via a fluid inlet and output the downhole fluid via a fluid outlet, and wherein the main housing includes a valve seat disposed between the fluid inlet and the fluid outlet; a valve plug configured to move along the central bore between an open position and a closed position, wherein the valve plug is configured to interface with the valve seat in the closed position to block fluid flow through the main housing; a ball screw configured to rotate in response to actuation of a motor, wherein the motor is configured to drive rotation of the ball screw in response to receiving the actuation signal; a ball nut configured to move axially along the ball screw in a first axial direction in response to rotation of the ball screw; a ball housing insert having an anchor end and a retainer end, wherein the anchor end is secured to the ball nut, wherein at least a portion of the retainer end is disposed about the valve plug in the open position, and wherein the retainer end includes a ball slot; a ball release collar having a shallow channel and a deep channel each formed in an inner surface of the ball release collar, wherein the ball release collar is configured to move along the ball housing insert between a holding position with the shallow channel aligned with the ball slot and a release position with the deep channel aligned with the ball slot; at least one ball disposed at least partially within the ball slot of the ball housing insert, wherein the at least one ball is configured to secure the valve plug to the ball housing insert with the ball release collar in the holding position, and wherein the at least one ball is configured to move to release the valve plug in response to the ball release collar moving from the holding position to the release position; and a spring disposed between the ball nut and the valve plug, wherein the spring is configured to drive the valve plug from the open position to the closed position in response to the at least one ball releasing the valve plug.

The present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole signal generation system, comprising:

a main housing having a central bore configured to receive downhole fluid via a fluid inlet and output the downhole fluid via a fluid outlet, and wherein the main housing includes a valve seat disposed between the fluid inlet and the fluid outlet;

a valve plug configured to move along the central bore between an open position and a closed position, wherein the valve plug is configured to interface with the valve seat in the closed position to block fluid flow through the main housing;

a ball housing insert disposed at least partially about the valve plug in the open position, and wherein the ball housing insert includes a ball slot;

a ball release collar having a shallow channel and a deep channel each formed in an inner surface of the ball release collar, wherein the ball release collar is configured to move along the ball housing insert between a holding position with the shallow channel aligned with the ball slot and a release position with the deep channel aligned with the ball slot;

at least one ball disposed at least partially within the ball slot of the ball housing insert, wherein the at least one ball is configured to secure the valve plug to the ball housing insert with the ball release collar in the holding position, and wherein the at least one ball is configured to move to release the valve plug in response to the ball release collar moving from the holding position to the release position; and a spring configured to drive the valve plug from the open position to the closed position in response to the at least one ball releasing the valve plug.

2. The downhole signal generation system of claim 1, further comprising a ball screw configured to rotate in response to actuation of a motor and a ball nut configured to move axially along the ball screw in a first axial direction in response to rotation of the ball screw in a first circumferential direction, and wherein the ball housing insert includes an anchor end and a retainer end, wherein the anchor end is rigidly secured to the ball nut such that the ball housing insert is configured to move in response to movement of the ball nut.

3. The downhole signal generation system of claim 2, wherein the ball screw is at least partially disposed within the central bore, and wherein the ball screw is axially aligned with the valve plug.

4. The downhole signal generation system of claim 2, wherein the retainer end extends axially away from the ball nut in a direction toward the valve seat, wherein at least a portion of the retainer end is disposed about the valve plug in the open position, wherein the retainer end includes the ball slot, and wherein the ball slot extends radially through the retainer end.

5. The downhole signal generation system of claim 2, further comprising a lug channel formed in the main housing and a release lug extending radially outward from the ball release collar, wherein the release lug is configured to extend into the lug channel formed in the main housing, wherein the release lug is configured to move the ball release collar from the holding position to the release position in response to contacting a first end of the lug channel, and wherein the release lug is configured to contact the first end of the lug channel in response to movement of the ball nut in the first axial direction.

6. The downhole signal generation system of claim 2, wherein the ball nut configured to move axially along the ball screw in a second axial direction to re-connect the housing insert to the valve plug in response to the valve plug actuating from the open position to the closed position.

7. The downhole signal generation system of claim 2, wherein the ball nut is configured to move axially along the ball screw to drive the ball housing insert in a second axial direction to align to the ball slot of the ball housing insert with an anchor slot of the valve plug in response to the valve plug actuating from the open position to the closed position, and wherein a release lug of the ball release collar is configured to move the ball release collar from the release position to the holding position in response to contacting a second end of a lug channel, and wherein the release lug is configured to contact the second end of the lug channel in response to movement of the ball nut in the second axial direction.

8. The downhole signal generation system of claim 2, wherein the at least one ball is configured to secure the valve plug to the ball housing insert in the closed position in response to the ball release collar moving to the holding position, wherein the ball nut is configured to move axially along the ball screw to drive the ball housing insert in the first axial direction to move the valve plug from the closed position to the open position in response to the at least one ball securing the valve plug to the ball housing insert in the closed position.

9. The downhole signal generation system of claim 2, wherein the spring is configured to drive the valve plug from the open position to the closed position at a faster rate than the ball screw is configured to move the valve plug from the closed position to the open position to generate a predefined pressure pulse signal.

10. The downhole signal generation system of claim 1, wherein the valve plug includes a sealing surface configured to interface with the valve seat, and wherein the valve plug includes an anchor groove configured to receive the at least one ball in the closed position.

11. The downhole signal generation system of claim 1, wherein the valve plug includes an anchor groove formed in a radially outer surface of the valve plug, wherein an inner surface of the shallow channel of the ball release collar is configured to hold the at least one ball within the anchor groove and the ball slot in the holding position, and wherein an interface between the at least one ball and the anchor groove is configured to restrain axial movement of the valve plug with respect to the ball housing insert.

12. The downhole signal generation system of claim 11, wherein the at least one ball is configured to move radially outward from the anchor groove and at least partially into the deep channel of the ball release collar in response to the ball release collar moving from the holding position to the release position.

13. The downhole signal generation system of claim 1, further comprising a seal slot formed in a radially inner surface of the main housing and a seal disposed within the seal slot, wherein the seal is configured to form a seal between the valve plug and the main housing.

14. The downhole signal generation system of claim 1, wherein the fluid inlet is formed through a radially outer surface of the main housing, and wherein the fluid outlet is formed at a first axial end of the main housing.

15. The downhole signal generation system of claim 14, wherein the valve seat is formed in the central bore between the first axial end of the main housing and the fluid inlet, wherein the valve seat extends radially inward from an inner surface of the main housing, and wherein the valve seat is configured to interface with the valve plug in the closed position to seal flow through the central bore at the valve seat.

16. The downhole signal generation system of claim 1, further comprising a downhole tool housing having a flow path, wherein fluid flow is configured to flow into the main housing from the flow path, and wherein the downhole tool includes an actuation mechanism configured to receive fluid flow from the flow path to actuate a downhole tool.

17. A downhole signal generation system, comprising:

a main housing having a central bore configured to receive downhole fluid via a fluid inlet formed in the main housing and output the downhole fluid via a fluid outlet formed in the main housing, and wherein the main housing includes a valve seat disposed between the fluid inlet and the fluid outlet;

a lug channel formed in the main housing;

a valve plug disposed within the central bore, wherein the valve plug is configured to move along the central bore between an open position and a closed position, wherein the valve plug is configured to interface with the valve seat in the closed position to block fluid flow through the main housing from the fluid inlet to the fluid outlet;

a ball screw configured to rotate in response to actuation of a motor;

a ball nut configured to move axially along the ball screw in a first axial direction in response to rotation of the ball screw;

a ball housing insert having an anchor end and a retainer end, wherein the anchor end is secured to the ball nut, wherein at least a portion of the retainer end is disposed about the valve plug in the open position, and wherein the retainer end includes a ball slot;

a ball release collar disposed at least partially about the ball housing insert, wherein the ball release collar includes a shallow channel and a deep channel each formed in an inner surface of the ball release collar, and wherein the ball release collar is configured to move along the ball housing insert between a holding position with the shallow channel aligned with the ball slot and a release position with the deep channel aligned with the ball slot;

a release lug extending radially outward from the ball release collar and into the lug channel formed in the main housing, wherein the release lug is configured to move the ball release collar from the holding position to the release position in response to contacting a first end of the lug channel;

at least one ball disposed at least partially within the ball slot of the ball housing insert, wherein the at least one ball is configured to secure the valve plug to the ball housing insert with the ball release collar in the holding position, and wherein the at least one ball is configured to move to release the valve plug in response to the ball release collar moving from the holding position to the release position; and a spring disposed between the ball nut and the valve plug, wherein the spring is configured to drive the valve plug from the open position to the closed position in response to the at least one ball releasing the valve plug.

18. The downhole signal generation system of claim 17, further comprising a second lug channel formed in the main housing and a stop lug extending radially outward from the ball nut, wherein the stop lug is configured to extend into the second lug channel formed in the main housing, wherein the stop lug is configured to restrain axial movement of the ball nut in the first axial direction in response to contacting a first end of the second lug channel and restrain axial movement of the ball nut in a second axial direction in response to contacting a second end of the second lug channel.

19. The downhole signal generation system of claim 17, further comprising an electronic control board configured to output an actuation signal to the motor, wherein the motor is configured to drive rotation of the ball screw in response to receiving the actuation signal.

20. A downhole system, comprising:

a downhole tool housing having a flow path, wherein fluid flow is configured to flow into the downhole tool housing via the flow path;

an electronic control board disposed within the downhole tool housing and configured to output an actuation signal;

an actuation mechanism disposed within the downhole tool housing and configured to receive the fluid flow from the flow path for actuating a downhole tool, wherein the actuation mechanism is configured to actuate the downhole tool from a first state to a second state;

a signal generator housing disposed within the downhole tool housing, wherein the signal generator includes a main housing having a central bore configured to receive downhole fluid via a fluid inlet and output the downhole fluid via a fluid outlet, and wherein the main housing includes a valve seat disposed between the fluid inlet and the fluid outlet;

a valve plug configured to move along the central bore between an open position and a closed position, wherein the valve plug is configured to interface with the valve seat in the closed position to block fluid flow through the main housing;

a ball screw configured to rotate in response to actuation of a motor, wherein the motor is configured to drive rotation of the ball screw in response to receiving the actuation signal;

a ball nut configured to move axially along the ball screw in a first axial direction in response to rotation of the ball screw;

a ball housing insert having an anchor end and a retainer end, wherein the anchor end is secured to the ball nut, wherein at least a portion of the retainer end is disposed about the valve plug in the open position, and wherein the retainer end includes a ball slot;

a ball release collar having a shallow channel and a deep channel each formed in an inner surface of the ball release collar, wherein the ball release collar is configured to move along the ball housing insert between a holding position with the shallow channel aligned with the ball slot and a release position with the deep channel aligned with the ball slot;

at least one ball disposed at least partially within the ball slot of the ball housing insert, wherein the at least one ball is configured to secure the valve plug to the ball housing insert with the ball release collar in the holding position, and wherein the at least one ball is configured to move to release the valve plug in response to the ball release collar moving from the holding position to the release position; and a spring disposed between the ball nut and the valve plug, wherein the spring is configured to drive the valve plug from the open position to the closed position in response to the at least one ball releasing the valve plug.

* * * * *